US005857540A

United States Patent [19]

Sadeck

[11] Patent Number: 5,857,540

[45] Date of Patent: Jan. 12, 1999

[54] HARNESS FOR HUMAN WEAR

[75] Inventor: James E. Sadeck, East Freetown, Mass.

[73] Assignee: The United States of America as represented by the Secretary of the Army, Washington, D.C.

[21] Appl. No.: 819,577

[22] Filed: Mar. 14, 1997

[51] Int. Cl.[6] ..... A62B 35/00

[52] U.S. Cl. ..... 182/6; 182/3

[58] Field of Search ..... 182/3, 6, 7

[56] References Cited

U.S. PATENT DOCUMENTS

| | | | |
|---|---|---|---|
| 702,858 | 6/1902 | Hendricks | 182/6 |
| 4,714,135 | 12/1987 | Bell et al. | 182/3 X |
| 5,036,548 | 8/1991 | Gilliot | 2/81 |
| 5,067,585 | 11/1991 | Bell | 182/7 |
| 5,136,724 | 8/1992 | Gilliot | 182/3 |
| 5,145,027 | 9/1992 | Petzl | 182/6 |
| 5,289,590 | 3/1994 | Larson | 2/227 |
| 5,360,082 | 11/1994 | Bell | 182/3 |
| 5,445,114 | 8/1995 | Walker | 119/857 |

FOREIGN PATENT DOCUMENTS

| | | | |
|---|---|---|---|
| 2530151 | 1/1984 | France | 182/3 |
| 913966 | 6/1954 | Germany | 182/3 |
| 4224334 | 1/1994 | Germany | 182/7 |
| 516256 | 12/1939 | United Kingdom | 182/7 |
| 2207036 | 1/1989 | United Kingdom | 182/3 |

*Primary Examiner*—Alvin Chin-Shue

*Attorney, Agent, or Firm*—Vincent J. Ranucci

[57] ABSTRACT

A harness for human wear comprises an elongated belt for encircling a waist of a wearer. A first strap is fixed to the belt and is extendible transversely of the belt with a longer portion of the first strap extending from a lower edge of the belt and a shorter portion of the first strap extending from an upper edge of the belt, the first strap having loops at each end thereof. A second strap is fixed to the belt and is extendible transversely of the belt with a longer portion of the second strap extending from the lower edge of the belt and a shorter portion of the second strap extending from the upper edge of the belt, the second strap having loops at each end thereof. First and second ends of the belt are connectable together, and the loops are adapted for disposal at a substantially common point for engagement with a single connector member.

6 Claims, 3 Drawing Sheets

HARNESS FOR HUMAN WEAR

STATEMENT OF GOVERNMENT INTEREST

The invention described herein may be manufactured, used and licensed by or for the Government for Governmental purposes without the payment to us of any royalty thereon.

BACKGROUND OF THE INVENTION (1) Field of the Invention

This invention relates to a harness for human wear, and is directed more particularly to a harness for use as an emergency egress/descent harness and a safety restraint.

(2) Description of the Prior Art

Harnesses available for egress/descent, and as safety restraints, typically are either full body harnesses or single-strap belts having a load ring thereon. The former are not in favor among sport climbers, fire fighters, bridge workers, special weapons and tactics teams, and the like, because of the inconvenience of donning the harness and the interference of the harness with the other gear or weapons carried by the wearer. Those who have need of such devices often elect not to carry them, taking a chance that an emergency situation requiring their use will not arise. The latter are preferred because of the ease of use and lack of interference with other equipment borne by the wearer, and because since a belt is customarily worn any how, one need not be carried and donned in emergency situations. However, putting a load ring on a belt at any point causes the body weight to be supported only at the waist.

Accordingly, there is a need for a belt which encounters little resistance to wear, and which, when circumstance warrant, is readily converted to a harness affording waist and leg support.

SUMMARY OF THE INVENTION

In view thereof, an object of the invention is to provide a harness for human wear which in a first mode constitutes a belt for wear around the waist of a human, and, in a second mode constitutes a harness providing waist and leg support.

With the above and other objects in view, as will hereinafter appear, a feature of the present invention is the provision of a harness for human wear comprising an elongated belt for encircling a waist of a wearer. A first strap is fixed to the belt and is extendible transversely of the belt with a longer portion of the first strap extending from a lower edge of the belt and a shorter portion of the first strap extending from an upper edge of the belt, the first strap having loops at each end thereof. A second strap is fixed to the belt and is extendible transversely of the belt with a longer portion of the second strap extending from the lower edge of the belt and a shorter portion of the second strap extending from the upper edge of the belt, the second strap having loops at each end thereof. First and second ends of the belt are connectable together, and the loops are adapted for disposal at a common point for engagement with a single connector member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
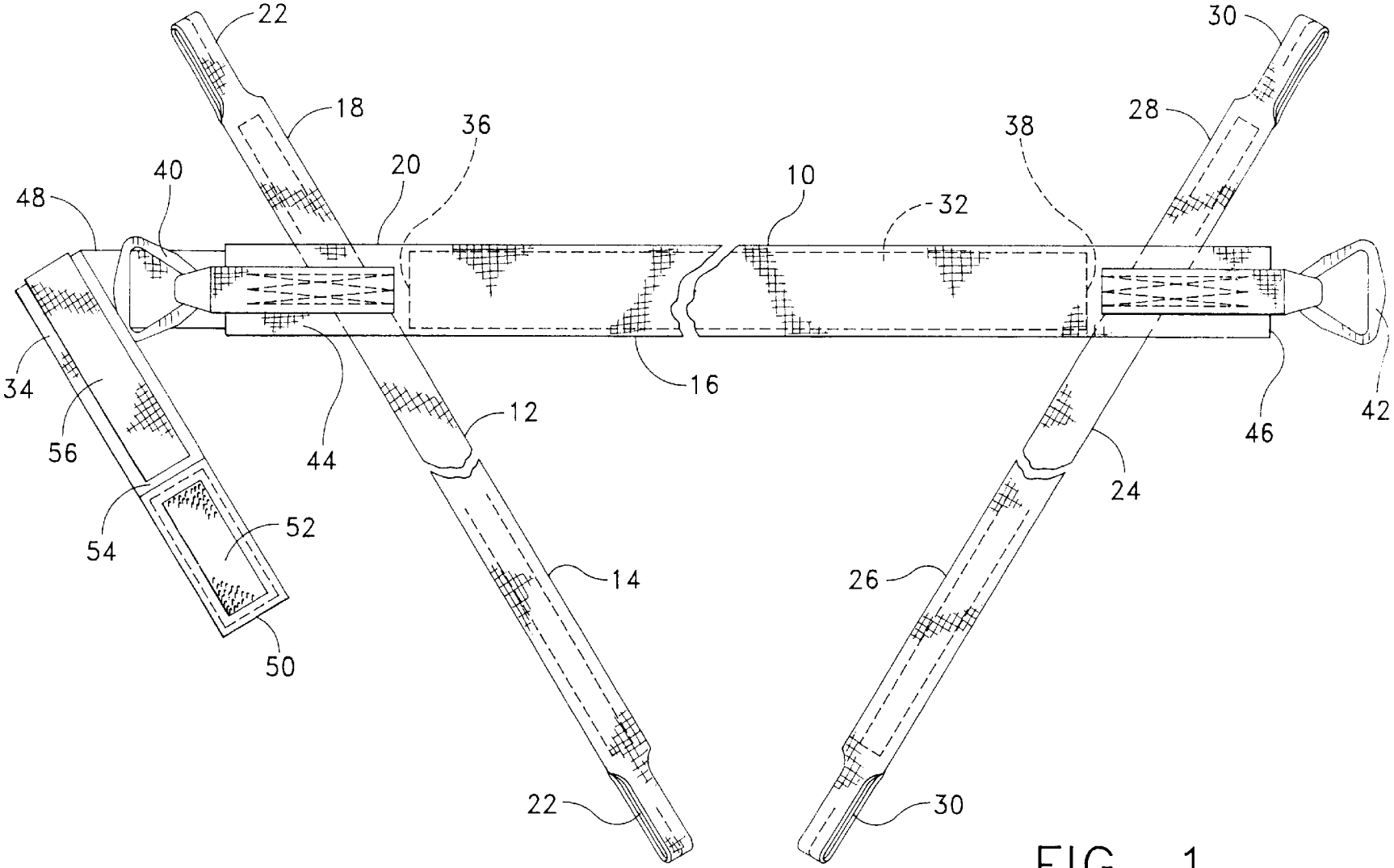
FIG. 1 is a generally front elevational view, partly in perspective, of one form of harness illustrative of an embodiment of the invention, the harness being shown in a first mode.

Referring to FIG. 1, it will be seen that the illustrative harness includes an elongated belt 10 for encircling a waist of a wearer. The belt 10 preferably is of a high-strength nylon webbing, but may be of any suitably strong and flexible material. A first strap 12 is fixed to the belt 10, as by stitching, and is extendible transversely of the belt 10. A longer portion 14 of the strap 12 extends from a lower edge 16 of the belt 10, and a shorter portion 18 of the strap 12 extends from an upper edge 20 of the belt 10. The strap longer portion 14 and shorter portion 18 are each provided with a loop 22 at the end thereof.

Similarly, a second strap 24 is fixed to the belt 10 and is extendible transversely of the belt 10 with a longer portion 26 of the second strap 24 extending from the lower edge 16 of the belt 10, and a shorter portion 28 of the second strap 24 extending from the upper edge 20 of the belt 10. The second strap longer portion 26 and shorter portion 28 are each provided with a loop 30 at the end thereof.

Referring again to FIG. 1, it will be seen that an open ended elongated pocket 32 is fixed to an outside surface 34 of the belt 10 and is configured to receive at a first open end 36 the longer and shorter portions 14, 18 of the first strap 12, and is configured to receive at a second open end 38 the longer and shorter portions 26, 28 of the second strap 24. Thus, the straps 12, 24 may be substantially entirely stowed in the pocket 32, as is illustrated in FIG. 2.

To facilitate the stowage of the straps 12, 24 in the pocket 32, the first strap 12 is fixed to the belt 10 proximate the first open end 36 of the pocket 32, with the pocket open end 36 being adapted to receive the first strap longer and shorter portions 14, 18. Similarly, the second strap 24 is fixed to the belt 10 proximate the second open end 38 of the pocket 32, with the pocket open end 38 being adapted to receive the second strap longer and shorter portions 26, 28.

Figure 2:
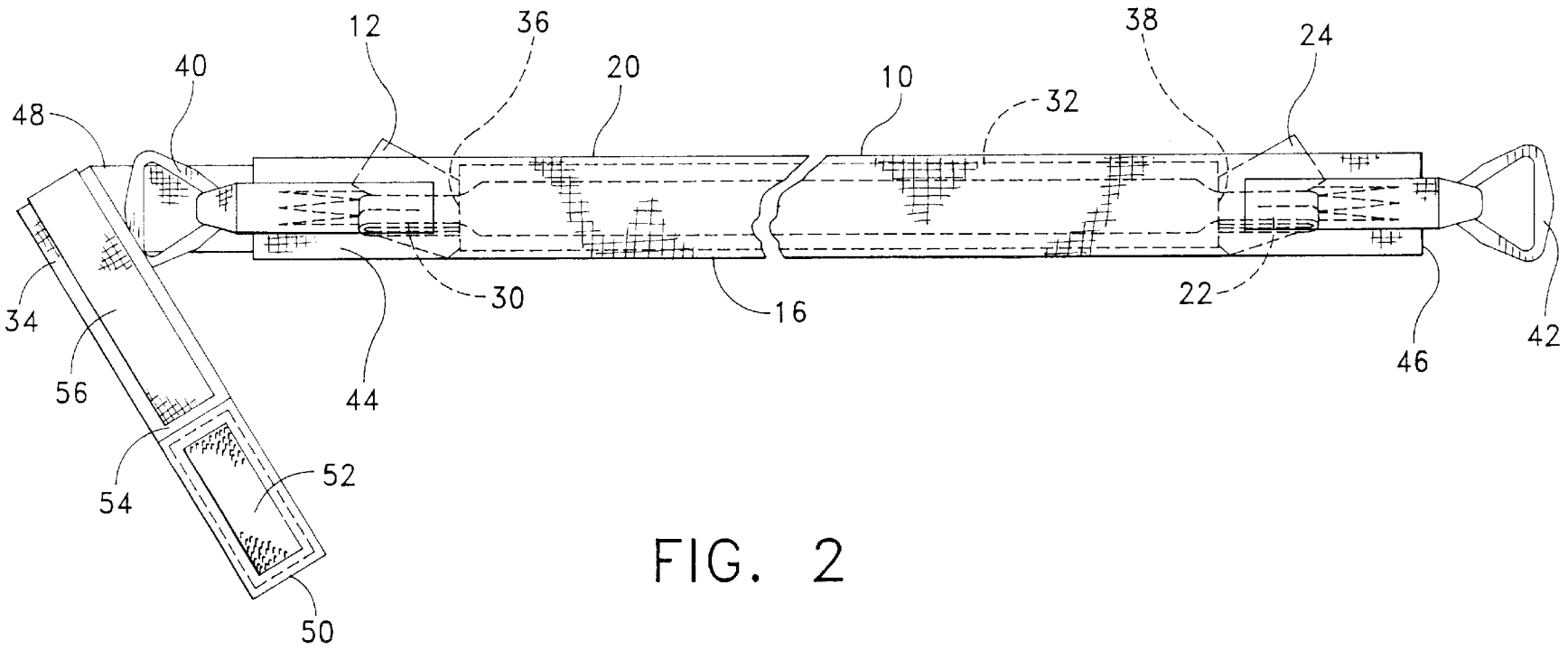
FIG. 2 is a generally front elevation view, partly in perspective, of the harness of FIG. 1, shown in a second mode.
Figure 3:
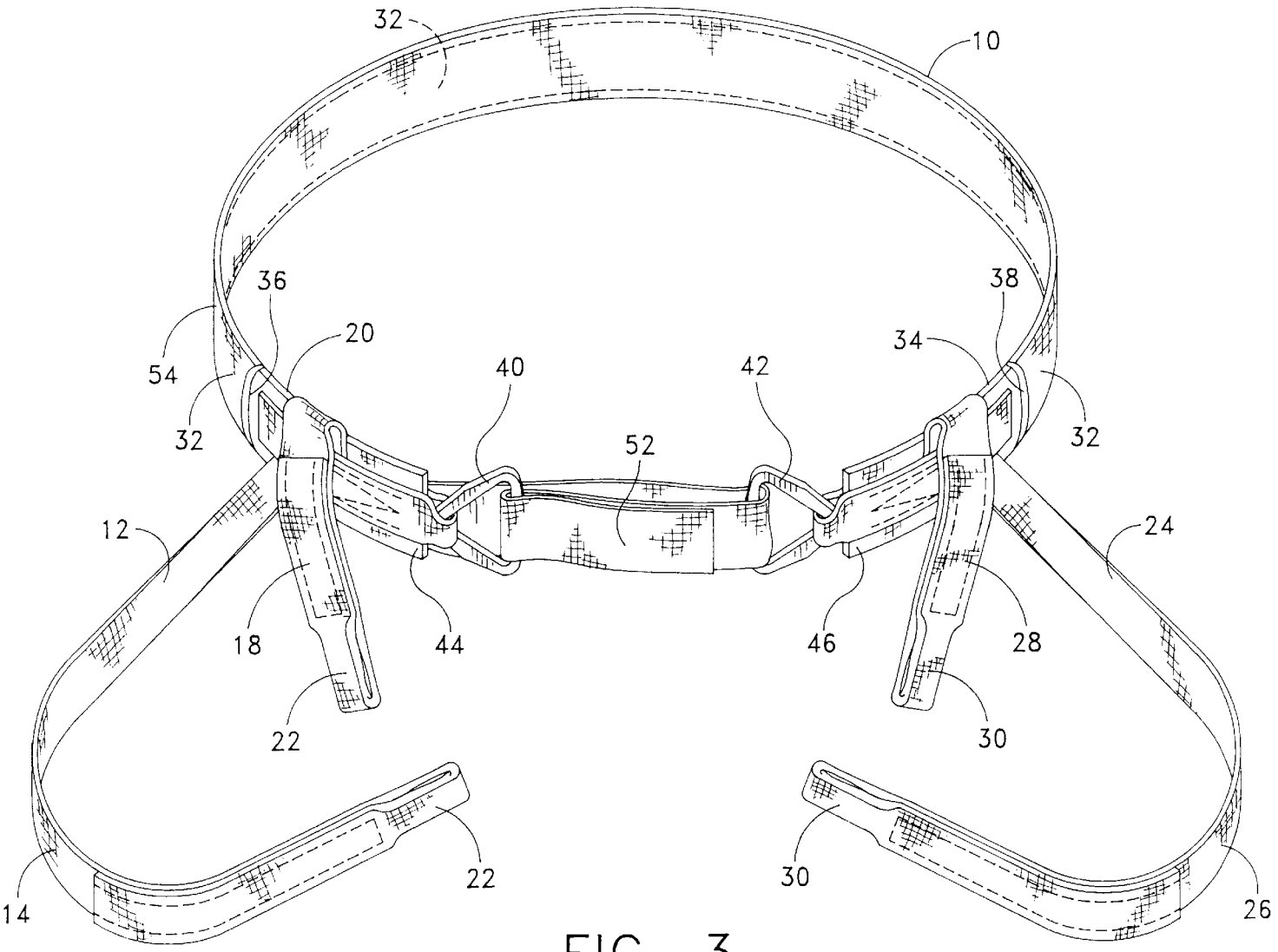
FIG. 3 is a perspective view of the harness of FIG. 2 shown in a configuration for use in the second mode.

Referring to FIGS. 1–3, it will be seen that the belt 10 is provided with first and second loop fittings 40, 42 fixed to respectively, first and second belt ends 44, 46. At the belt first end 44 there is fixed an elongated extension 48 having on an outside portion 54 thereof, proximate a free end 50 thereof, a first connector 52, such as a hook or pile connector, and further having on the outside portion 54 thereof a second connector 56 complementary to the first connector 52. The extension 48 is extendible through the second loop fitting 42 and, thereafter, through the first loop fitting 40. The first and second connectors 52, 56 are then engaged with each other between the loop fittings 40, 42 (FIG. 3) to close the belt 10. The belt 10 may be provided with a load ring (not shown) either sewn into the belt or loosely riding on the belt.

The strap end loops 22, 30 may be gathered in one location for acceptance of a D-ring, hook, rope or cable, snap fastener, and the like (not shown).

Thus, a wearer may don what is essentially a belt, serving the same purposes as a simple belt, such as holding up trousers, and the like, and which is unobtrusive and comfortable to wear, but which may, in seconds, be converted easily into a harness by which one may be restrained, lifted, conveyed, etc., utilizing waist and leg support.

It is to be understood that the present invention is by no means limited to the particular construction herein disclosed and/or shown in the drawings, but also comprises any modifications or equivalents within the scope of the claims.

What is claimed is:

1. A harness for human wear, said harness comprising:

an elongated belt for encircling a waist of a wearer;

a first strap fixed to said belt and extendible transversely of said belt with a first portion of said first strap extending from a lower edge of said belt and a second portion of said first strap extending from an upper edge of said belt, first strap having connectors at each end thereof;

a second strap fixed to said belt and extendible transversely of said belt with a first portion of said second strap extending from said lower edge of said belt and a second portion of said second strap extending from said upper edge of said belt, said second strap having connectors at each end thereof;

first and second ends of said belt being connectable together, and said strap end connectors being adapted for disposal at a common point for engagement with a single connector member, said member being adapted for bearing a load for permitting an egress;

an elongated pocket open at both ends and fixed to a surface of said belt and extending substantially the entire length of the belt and storing said first and second straps in a configuration for preventing recognition of said straps along the length of the belt;

said belt and first and second straps when said straps are in a stored position being configured for providing waist and leg support; and said harness further comprising a first loop fitting fixed to a first end of said belt and a second loop fitting fixed to a second end of said belt, and an elongated extension fixed to said first end of said belt and extendible through said second loop fitting and, thereafter, through said first loop fitting, said extension having connectors thereon engageable with each other between said first and second loop fitting to close said belt.

2. The harness in accordance with claim 1 wherein said strap end connectors comprise loops.

3. The harness in accordance with claim 2 wherein said loops are integral with said straps.

4. A harness for human wear, said harness comprising:

an elongated belt for encircling a waist of a wearer;

a first strap fixed to said belt and extendible transversely of said belt with a longer portion of said first strap extending from a lower edge of said belt and a shorter portion of said first strap extending from an upper edge of said belt, first strap having loops at each end thereof;

a second strap fixed to said belt and extendible transversely of said belt with a longer portion of said second strap extending from said lower edge of said belt and a shorter portion of said second strap extending from said upper edge of said belt, said second strap having loops at each end thereof;

first and second ends of said belt being connectable together, and said loops being adapted for disposal at a common point for engagement with a single connector member, said member being adapted for bearing a load for permitting an egress;

an elongated pocket open at both ends and fixed to a surface of said belt and extending substantially the entire length of the belt and storing said first and second straps along the length of the belt in a configuration for preventing recognition of said straps when said straps are in a stored position;

said belt and first and second straps being configured for providing waist and leg support; and said harness further comprising a first loop fitting fixed to a first end of said belt and a second loop fitting fixed to a second end of said belt, and an elongated extension fixed to said first end of said belt and extendible through said second loop fitting and, thereafter, through said first loop fitting, said extension having connectors thereon engageable with each other between said first and second loop fittings to close said belt.

5. The harness in accordance with claim 4 wherein said first strap is fixed to said belt proximate a first end of said pocket, said pocket being adapted to receive said first strap longer and shorter portions, and said second strap is fixed to said belt proximate a second end of said pocket, said pocket being adapted to receive said second strap longer and shorter portions.

6. The harness in accordance with claim 4 wherein said connectors comprise hook and pile connectors, respectively.

* * * * *